US006400081B1

(12) United States Patent
Matsumoto et al.

(10) Patent No.: US 6,400,081 B1
(45) Date of Patent: Jun. 4, 2002

(54) POSITION ALIGNMENT STRUCTURE FOR PLASMA DISPLAY PANEL

(75) Inventors: Tetsuya Matsumoto; Takashi Nakano, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/572,279

(22) Filed: May 17, 2000

(30) Foreign Application Priority Data

May 20, 1999 (JP) ..... 11-140203
Jan. 31, 2000 (JP) ..... 2000-022795

(51) Int. Cl.[7] ..... H01J 17/49
(52) U.S. Cl. ..... 313/582; 313/586; 313/587; 313/292
(58) Field of Search ..... 313/582, 586, 313/587, 292

(56) References Cited

U.S. PATENT DOCUMENTS 5,619,097 A * 4/1997 Jones ..... 313/495
5,650,690 A * 7/1997 Haven ..... 313/422
5,734,224 A * 3/1998 Tagawa et al. ..... 313/493

* cited by examiner

*Primary Examiner*—Robert H. Kim
*Assistant Examiner*—Jurie Yun
(74) *Attorney, Agent, or Firm*—Arent Fox Kintner Plotkin & Kahn, PLLC

(57) ABSTRACT

To facilitate evaluation of the amount of a deviation in a column direction between a front substrate and a rear substrate upon assembly of a plasma display panel, thereby improving alignment accuracy between the front substrate and the rear substrate and performances of the resultant plasma display panel, there is provided a plasma display panel comprising partition 15 and position alignment-use ribs 20. The partition 15 is formed of vertical walls 15*a* extending in a column direction and horizontal walls 15*b* extending in a row direction on a rear glass substrate 13 so as to partition a discharge space S between a front glass substrate 10 and the rear glass substrate 13 in the row and column directions in accordance with unit luminous regions. The position alignment-use rib 20 is formed on the rear glass substrate, and is positioned in cell Ca which is positioned at the outside of the display region of the plasma display panel within spaces partitioned by the partition 15.

7 Claims, 8 Drawing Sheets

V–V CROSS–SECTION

W–W CROSS–SECTION

V2–V2 CROSS–SECTION

POSITION ALIGNMENT STRUCTURE FOR PLASMA DISPLAY PANEL

BACKGROUND OF THE INVENTION

The present invention relates to a surface discharge AC driving plasma display panel, and more particularly, to a structure for aligning the positions of the components of the plasma display panel upon its assembly.

In recent years, a surface discharge AC driving plasma display panel has drawn considerable attention as a color display device having a large area and a small thickness, and attempts have been made to popularize the device.

FIG. 6 is a plan view schematically showing the cell structure of a conventional surface discharge AC driving plasma display panel. FIG. 7 is a cross-sectional view taken along the line V—V of FIG. 6. FIG. 8 is a cross-sectional view taken along the line W—W of FIG. 6.

Referring to FIGS. 6–8, on the back surface of a front glass substrate 1, which is a display surface of the plasma display panel, a plurality of row electrode pairs (X', Y'), a dielectric layer 2 covering these row electrode pairs (X', Y'), and a protection layer 3 made of MgO and covering the back surface of this dielectric layer 2 are provided in this order.

Each of the row electrodes X', Y' is composed of transparent electrodes Xa', Ya' made of a transparent conductive film, such as ITO, having a large width, and bus electrodes Xb' Yb' made of a metal film having a narrow width for compensating for the electric conductivity of the transparent electrode Xa', Ya'.

These row electrodes X' and Y' are disposed alternately with a discharge gap g' therebetween in the column direction, and each row electrode pair (X', Y') constitutes one line (row) L of the matrix display.

On a rear glass substrate 4, which faces the front glass substrate 1 through a discharge space S' filled with a discharge gas, a plurality of column electrodes D' is arranged to extend in a direction perpendicular to the row electrode pairs X', Y'. Belt-shape partitions 5 are formed between the column electrodes D' so as to extend in parallel with each other. Fluorescent layers 6 of three colors, R, G, B, are formed to cover the side surfaces of the partitions 5 and the column electrodes D'.

Thus, the discharge space S' is defined by the partitions 5, and thereby discharge cells C' constituting respective unit luminous regions are formed at intersections of the column electrodes D' and the row electrode pairs (X', Y') in respective display line L.

The above-mentioned surface discharge AC driving plasma display panel displays images in the following manner. First, through addressing operation, electric discharges are selectively effectuated between the row electrode pairs (X', Y') and the column electrodes D' at the respective discharge cells C', thereby distributing lightening cells (discharge cells in which wall charges are formed in the corresponding dielectric layer 2) and light-out cells (discharge cells in which wall charges are not formed in the corresponding dielectric layer 2) on the panel in correspondence with an image to be displayed.

After this addressing operation, a discharge-maintaining pulse is applied alternately to the row electrode pairs (X', Y') for all the display lines L at once. Every time this discharge-maintaining pulse is applied, surface discharge is generated at the lightening cells.

This way, ultraviolet rays are generated at the lightening cells by surface discharge, and the fluorescent layers 6 of R, G, B in the discharge cells C' are respectively excited to emit light, thereby forming the image to be displayed.

The plasma display panel having the above-mentioned structure is assembled by superimposing the front glass substrate 1 having the row electrodes X', Y', dielectric layer 2, and protection layer 3 formed thereon onto the rear glass substrate 4 having the column electrodes D', partitions 5, and fluorescent layers 6 formed thereon.

At the time of this assembly, it is necessary to ascertain an offset between a pattern of the row electrodes X', Y' formed on the front glass substrate 1 and partitions 5 formed on the rear glass substrate 4. This evaluation is performed by detecting the amount of a deviation of an alignment-use mark on the rear glass substrate 4 from the pattern of the row electrodes X', Y' (positional relationship between the row electrodes and the partitions) in the condition where the front glass substrate 1 is temporarily fixed to the rear glass substrate 4 by clips in advance of cementing these substrates together.

Such evaluation is necessary because the deviation (alignment error) between the front glass substrate 1 and the rear glass substrate 4 causes a degradation in the luminance and a decrease in the power margin. Once the deviation is detected, the deviation is eliminated by applying a counter-offset.

Here, in the conventional surface discharge AC driving plasma display panel described above, as shown in FIG. 8, the fluorescent layers 6 are formed even on the side surfaces of the belt-shape partitions 5 in order to increase the luminous areas in the discharge cells C', thereby increasing the luminance of the display screen. Nonetheless, if the resolution of the screen is increased by reducing the size of each discharge cell C', the surface areas of the fluorescent layers 6 are accordingly reduced, and the resultant luminance decreases, which is a drawback.

Furthermore, if the pitch of the row electrode pairs (X', Y') is narrowed to achieve a higher resolution of the screen, discharge interference occurs between the discharge cells C' adjacent in the vertical direction, increasing a likelihood of misdischarge, which is another drawback.

In light of the above problems, the present applicant has previously proposed a novel surface discharge AC driving plasma display panel shown in FIGS. 9–11.

In this plasma display panel, a plurality of row electrode pairs (X, Y) is parallely arranged on the back surface of a front glass substrate 10, which is the display face, in such a way as to extend in the row direction of the front glass substrate 10 (the right and left direction in FIG. 9).

Each of the row electrodes X is composed of transparent electrodes Xa, each of which is formed to have the shape of the letter "T" and is made of a transparent conductive film, such as ITO, and a bus electrode Xb made of a metal film, which extends in the row direction of the front glass substrate 10 and is connected to the narrow base end part of each transparent electrode Xa.

Similarly, each of the row electrodes Y is composed of transparent electrodes Ya, each of which is formed to have the shape of the letter "T" and is made of a transparent conductive film, such as ITO, and a bus electrode Yb made of a metal film, which extends in the row direction of the front glass substrate 10 and is connected to the narrow base end part of each transparent electrode Ya.

These row electrodes X and Y are alternately arranged in the column direction of the front glass substrate 10 (the vertical direction in FIG. 9). Each of the transparent electrodes Xa and Ya arranged along the respective bus electrodes Xb and Yb extends towards the corresponding paired row electrode so that the sides of the wider parts of the paired transparent electrodes Xa and Ya face each other through a discharge gap g having a predetermined distance.

Each of the bus electrodes Xb, Yb is formed of a black conductive layer Xb', Yb' on the display surface side and a primary conductive layer Xb", Yb" on the back side in a double-layered structure.

A black light absorption layer 17 is formed on the back surface of the front glass substrate 10 between the row electrode pairs (X, Y) adjacent in the column direction i.e., between the bus electrode Xb and the-bus electrode Yb.

Further, a dielectric layer 11 is formed on the back surface of the front glass substrate 10 to cover the row electrode pairs (X, Y). On the back surface of the dielectric layer 11, elevated dielectric layers 11A protruding from the back side of the dielectric layer 11 are formed at positions facing the bus electrode Xb and the bus electrode Yb, which are adjacent to each other and belong to the row electrode pairs (X, Y) adjacent, and at positions corresponding to a space between such bus electrodes Xb and Yb. The elevated dielectric layers extend in parallel with the bus electrodes Xb, Yb.

Also, a protection layer 12 made of MgO is formed at the back side of these dielectric layer 11 and elevated dielectric layers 11A.

On the other hand, on a display-side surface of the rear glass substrate 13, which is disposed in parallel with the front glass substrate 10, column electrodes D are arranged so as to extend in a direction perpendicular to the row electrode pairs (X, Y) (column direction) at positions where the transparent electrodes Xa and Ya of the respective row electrode pairs (X, Y) face each other. The column electrodes D are disposed in parallel with each other with a predetermined space therebetween.

Further, white dielectric layers 14 are formed on the display-side surface of the rear glass substrate 13 to cover the respective row electrodes D, and a partition 15 is formed on these dielectric layers 14.

This partition 15 is formed of vertical walls 15*a*, which extend in the column direction at spaces between the column electrodes D which are disposed in parallel with each other, and horizontal walls 15*b*, which extend in the row direction at the positions facing the elevated dielectric layers 11A, to construct a lattice shape.

Accordingly, a discharge space between the front glass substrate 10 and the rear glass substrate 13 is partitioned by this lattice-shape partition 15 in accordance with the regions where the paired transparent electrodes Xa and Ya in the respective row electrode pairs (X, Y) face each other, thereby forming respective rectangular-shape discharge cells C.

The side surfaces of the partition 15 which face the discharge space S are formed to have a substantially white color (i.e., light reflective layer).

The display-side surface of the vertical wall 15*a* of the partition 15 is not in contact with the protection layer 12 (see FIG. 11), and there exists a gap r therebetween. However, the display-side surface of the horizontal wall 15*b* is in contact with a portion of the protection layer 12 which covers the elevated dielectric layer 11A (see FIG. 10) so that the discharge cells C adjacent in the column direction are isolated, repectively.

In the plasma display panel having the structure above, as in the case of the conventional art, when the front glass substrate 10 and the rear glass substrate 13 are superimposed on each other upon its assembly, a deviation between patterns of the both substrates needs to be ascertained and eliminated before cementing the substrates together.

However, this newly proposed plasma display panel has the following draw back in conducting such a procedure. As seen from FIGS. 9–11, when viewed from the side of the front glass substrate 101 the horizontal wall 15*b* of the partition 15 is positioned at the back side of the black conductive layers Xb', Yb' of the bus electrodes Xb, Yb and at the back side of the light absorption layer 17 between these bus electrodes Xb, Yb. Thus, it is difficult to ascertain the amount of the deviation of the partition 15 relative to the front glass substrate 10 in the column direction by observing an alignment mark formed on the horizontal wall 15*b*.

SUMMARY OF THE INVENTION

The present invention is devised to solve the drawbacks which occur upon assembly of a plasma display panel, as described above.

An object of the present invention is to facilitate evaluation of the amount of a deviation in a column direction between a front substrate and a rear substrate upon assembly of a plasma display panel, a discharge space of which is partitioned by vertical walls and horizontal walls of a partition, thereby improving alignment accuracy between the front substrate and the rear substrate and the performances of the result ant plasma display panel.

To achieve the object above, in a first aspect of the present invention, there is provided a position alignment structure for a plasma display panel comprising a front substrate and a rear substrate opposite to the front substrate with a discharge space therebetween, said front substrate having thereon a plurality of row electrode pairs extending in a row direction and arranged in parallel in a column direction, each of the plurality of row electrode pairs defining a corresponding display line, said rear substrate having thereon a plurality of column electrodes extending in the column direction and arranged in parallel in the row direction, the column electrodes defining unit luminous regions in the discharge space at their respective intersecting positions with the row electrode pairs, a position alignment structure for the plasma display panel comprising: a partition on said rear substrate, having vertical wall parts extending in the column direction and horizontal wall parts extending in the row direction to partition the discharge space between said front substrate and said rear substrate in the column and row directions in accordance with the unit luminous regions; and a position alignment-use rib formed on said rear substrate and positioned at an outside of a display region of the plasma display panel for detecting a position of said front substrate relative to said rear substrate.

According to the first aspect of the present invention, the discharge space between the front substrate and the rear substrate is partitioned into the respective unit luminous regions by the partition having the vertical wall parts extending in the column direction and the horizontal wall parts extending in the row direction.

Upon assembly of this plasma display panel, the front glass substrate having the row electrode pairs and other structures formed thereon is superimposed on the rear glass substrate having the partition, the position alignment-use ribs; and other structures formed thereon, and they are temporarily fixed to each other. Then, distances between the position alignment-use rib positioned at the outside of the display region of the plasma display panel and particular structures formed on the front substrate, such as the bus electrodes extending in the row direction, which constitute the row electrode pair, are measured to determine whether the measured distances are different from predetermined values, thereby detecting positional deviations between the front substrate and the rear substrate.

This way, according to the first aspect of the present invention, upon assembly of the plasma display panel, position alignment between the superimposed front and rear substrates can be performed using the position alignment-use rib formed on the rear substrate at the outside of the display region of the plasma display panel. Therefore, even where the horizontal wall parts of the partition of the rear substrate superimposed in this manner cannot be observed from the side of the front substrate, the amount of the positional deviation between the front substrate and the rear substrate in the column direction can easily be ascertained at the time of assembly, thereby improving accuracy in position alignment between the front substrate and the rear substrate.

As a result, the performances of the resultant plasma display panel can be improved.

In a second aspect of the present invention, to achieve the object above, the position alignment structure for the plasma display panel is characterized in that, in addition to the construction of the first aspect above, the position alignment-use rib on the rear substrate is formed in a space positioned at the outside of the display region of the plasma display panel among spaces defined by the partition.

According to the second aspect of the present invention, position alignment of the front substrate relative to the rear substrate is performed using the position alignment-use rib formed in the space positioned at the outside of the display region of the plasma display panel among spaces defined by the partition.

In a third aspect of the present invention, to achieve the object above, the position alignment structure for the plasma display panel is characterized in that, in addition to the construction of the second aspect above, the position alignment-use rib is formed at a position separated from the opposing horizontal wall parts of the partition defining the space having the position alignment-use rib therein by respective distances being substantially the same at both sides.

In this position alignment structure for the plasma display panel according to the third aspect of the present invention, the position alignment-use rib is formed at the position separated from both sides of the horizontal wall parts of the partition partitioning the space by respective distances which are substantially the same at the both sides. Thus, when position alignment between the front substrate and the rear substrate is performed, the position alignment-use rib is aligned to be located at a position separated by an equal distance from a particular pair of structures which are formed on the front substrate at positions which would be, in alignment, symmetrical in the column direction with respect to the position alignment-use rib, such as bus electrodes constituting an row electrode pair.

Thus, according to the third aspect, by detecting the difference in the distances from the position alignment-use rib to the particular pair of structures on the front substrate, which are located on both sides with respect to the position alignment-use rib in the column direction, the positional deviation between the front substrate and the rear substrate can easily be ascertained.

In a fourth aspect of the present invention, to achieve the object above, the position alignment structure for the plasma display panel is characterized in that, in addition to the construction of the first aspect above, a position of the position alignment-use rib is set such that if the position alignment-use rib is translated in the row direction, the resulting position would be between two electrodes constituting the row electrode pair.

According to the fourth aspect of the position alignment structure for the plasma display panel of the present invention, when the position alignment of the front substrate and the rear substrate is performed, the position of the alignment-use rib translated in the row direction coincides with the position between two electrodes constituting the row electrode pair. Accordingly, position alignment between the front substrate and the rear substrate can easily conducted using even this relative positional relationship between the position alignment-use rib and the row electrode pair disposed within the display region of the plasma display panel.

In a fifth aspect of the present invention, to achieve the object above, the position alignment structure for the plasma display panel is characterized in that, in addition to the construction of the first aspect above, the partition and the position alignment-use rib are formed by patterning a glass layer in accordance with a predetermined pattern, the glass layer being formed on the rear substrate at a side facing the front substrate and being formed of a glass having a low melting point.

According to the fifth aspect of the position alignment structure of the present invention, the partition and the position alignment-use rib are simultaneously formed on the rear substrate by patterning. Thus, positioning of the position alignment-use rib with respect to the partition can be secured, and the accuracy in position alignment between the front substrate and the rear substrate can be improved.

In a sixth aspect of the present invention, to achieve the object above, the position alignment structure for the plasma display panel is characterized in that, in addition to the construction of the first aspect above, the position alignment-use rib on the rear substrate extends outwardly from the vertical wall part positioned at an end of the partition in a direction parallel to the horizontal wall parts, the position alignment-use rib being formed integrally with the partition.

According to the sixth aspect of the position alignment structure for the plasma display panel of the present invention, the position alignment of the front substrate relative to the rear substrate is conducted using the position alignment-use rib which is formed integrally with the partition in such a way as to extend outwardly from the vertical wall part positioned at the end of the partition.

In a seventh aspect of the present invention, to achieve the object above, the position alignment structure for the plasma display panel is characterized in that, in addition to the construction of the sixth aspect above, the position alignment-use rib is formed at a substantially center position of the vertical wall part of the partition.

According to the seventh aspect of the position alignment structure for the plasma display panel of the present invention, the position-alignment rib is formed at the substantially center position of the vertical wall part of the partition. Thus, when position alignment between the front substrate and the rear substrate is performed, the position alignment-use rib is aligned to be located at a position separated by an equal distance from a particular pair of structures which are formed on the front substrate at positions what would be, in alignment, symmetrical with respect to the position alignment-use rib in the column direction, such as bus electrodes constituting an row electrode pairs.

Thus, according to the seventh aspect, by detecting the difference in the distances from the position alignment-use rib to the particular pair of structures on the front substrate, which are located on both sides of the position alignment-use rib in the column direction, the positional deviation between the front substrate and the rear substrate can easily be ascertained.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The preferred embodiments of the present invention will be described in detail with reference to accompanying drawings.

Figure 1:
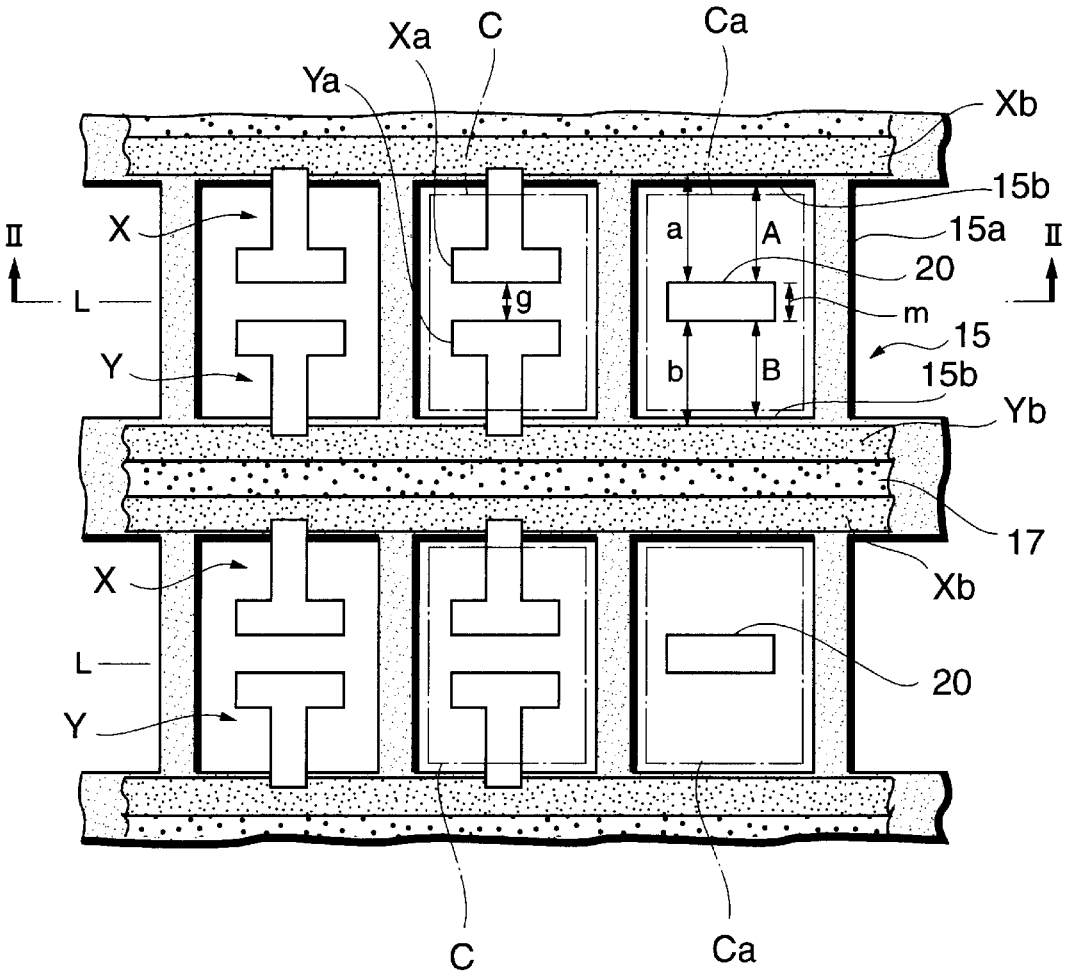
FIG. 1 is a plan view showing a first preferred embodiment according to the present invention.
Figure 2:
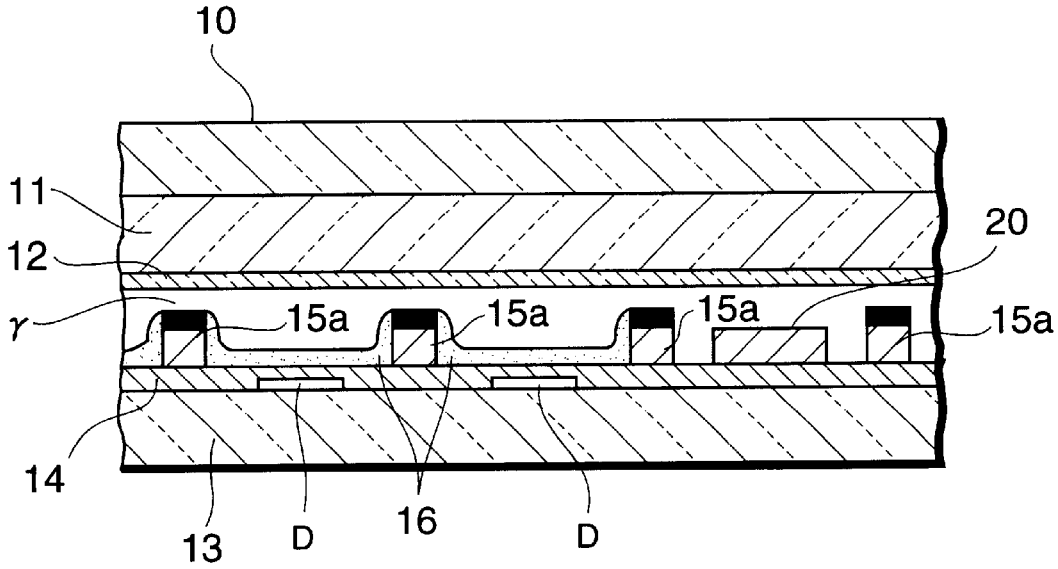
FIG. 2 is a cross-sectional view taken along the line II—II of FIG. 1.

FIG. 1 is a plan view of a first preferred embodiment of the present invention. FIG. 2 is a cross-sectional view taken along the line II—II of FIG. 1. These figures show the structure of discharge cells C, which are positioned in the display region, and cells Ca, which are positioned at the outside of the display region adjacent to the discharge cells C, both located at the periphery of a plasma display panel.

Figure 6:
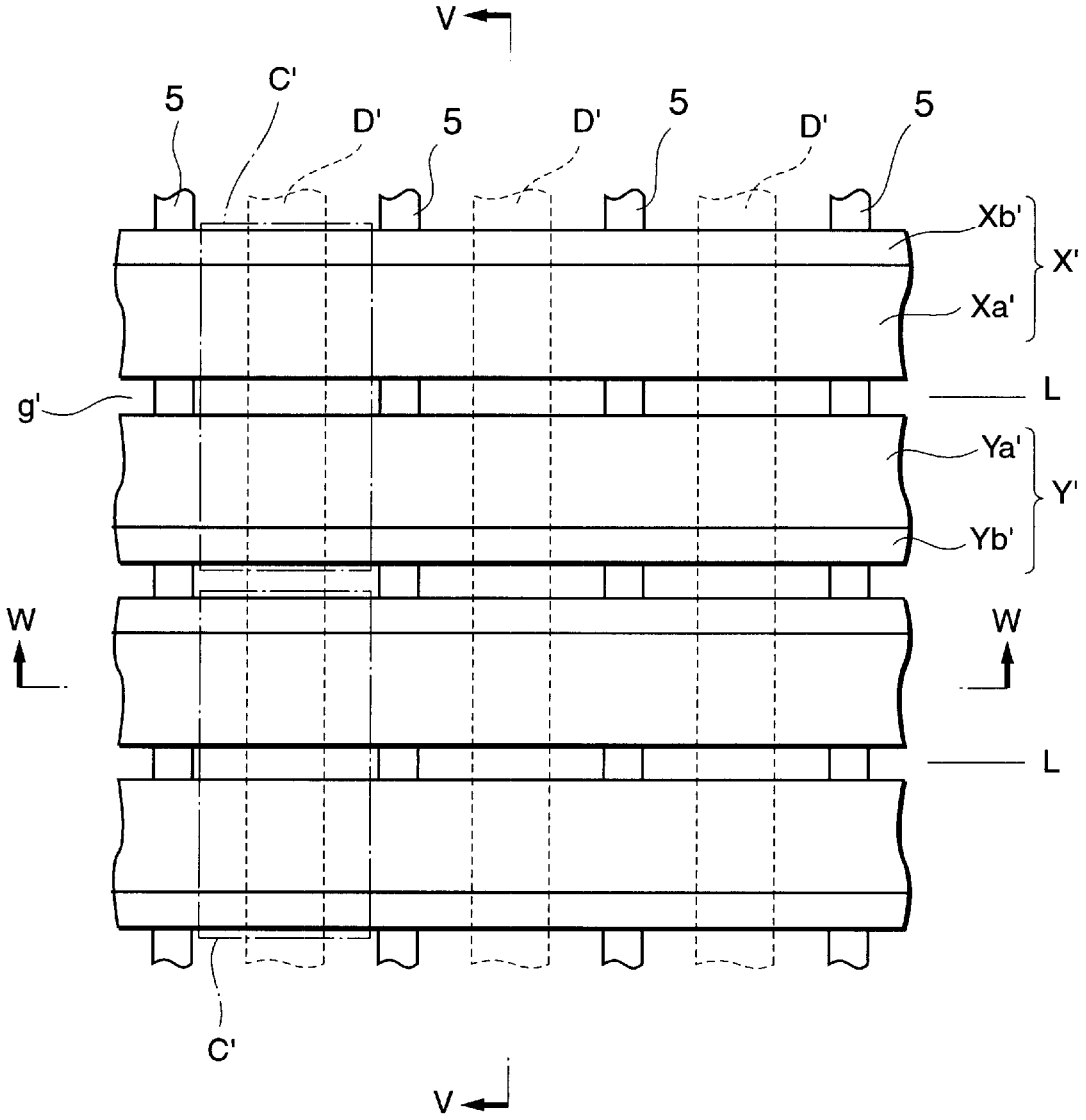
FIG. 6 is a plan view showing a structure of a conventional plasma display panel.
Figure 7:
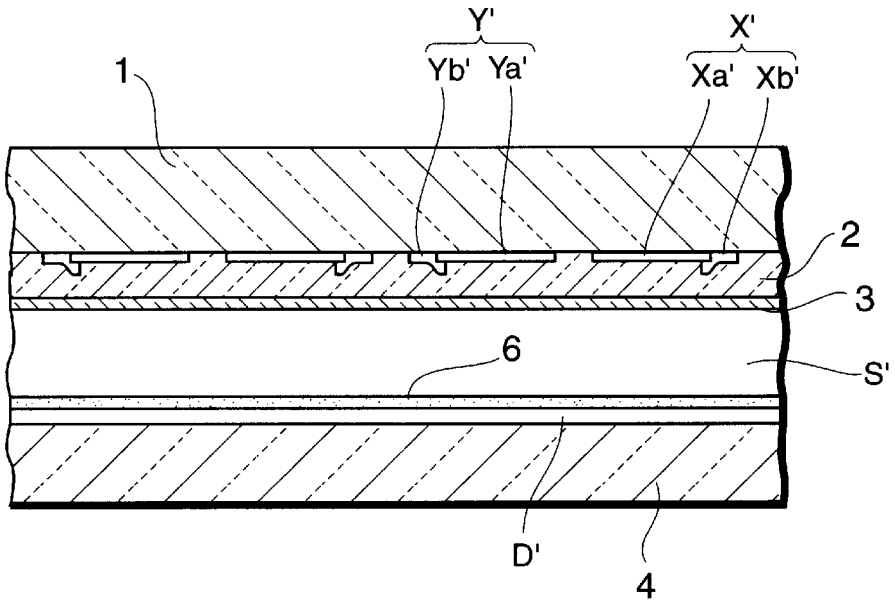
FIG. 7 is a cross-sectional view taken along the line V—V of FIG. 6.
Figure 8:
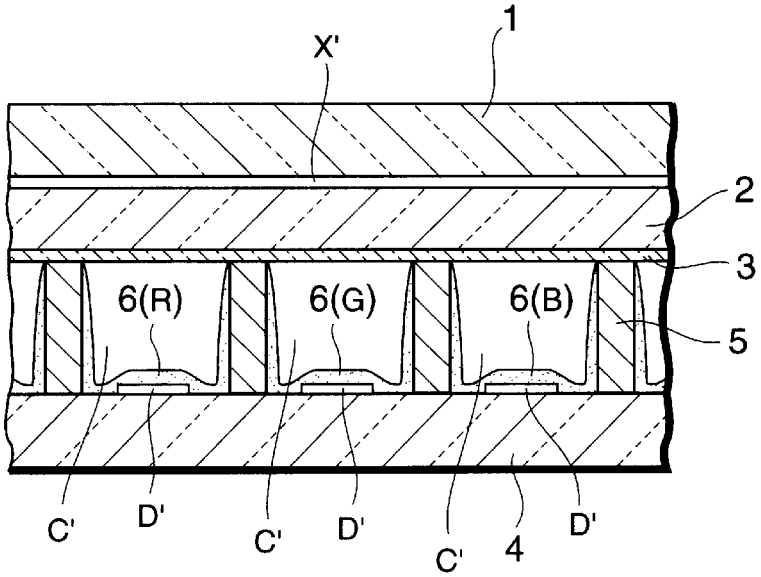
FIG. 8 is a cross-sectional view taken along the line W—W of FIG. 6.
Figure 9:
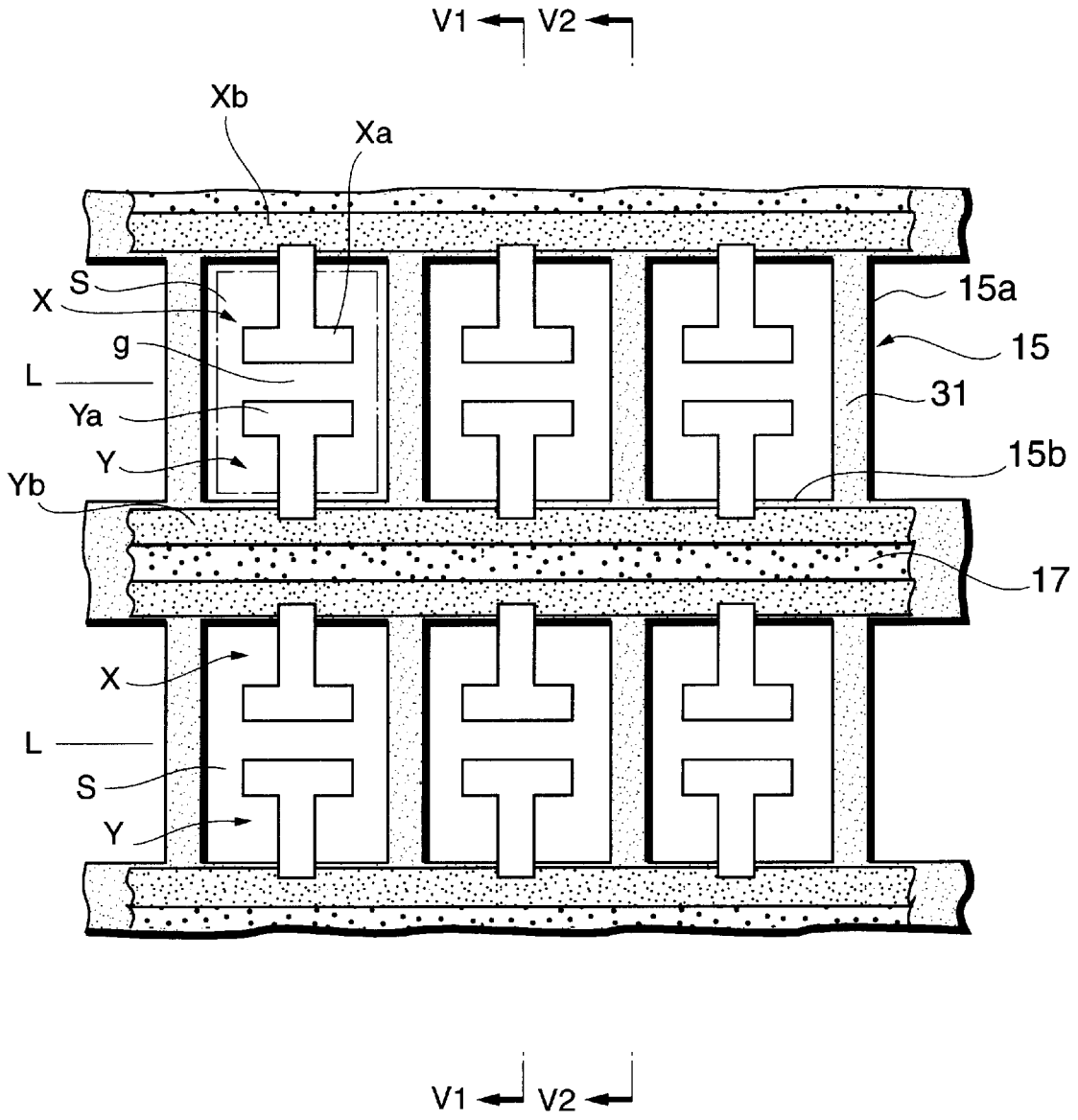
FIG. 9 is a cross-sectional view showing a construction of a plasma display panel according to a previous proposal.
Figure 10:
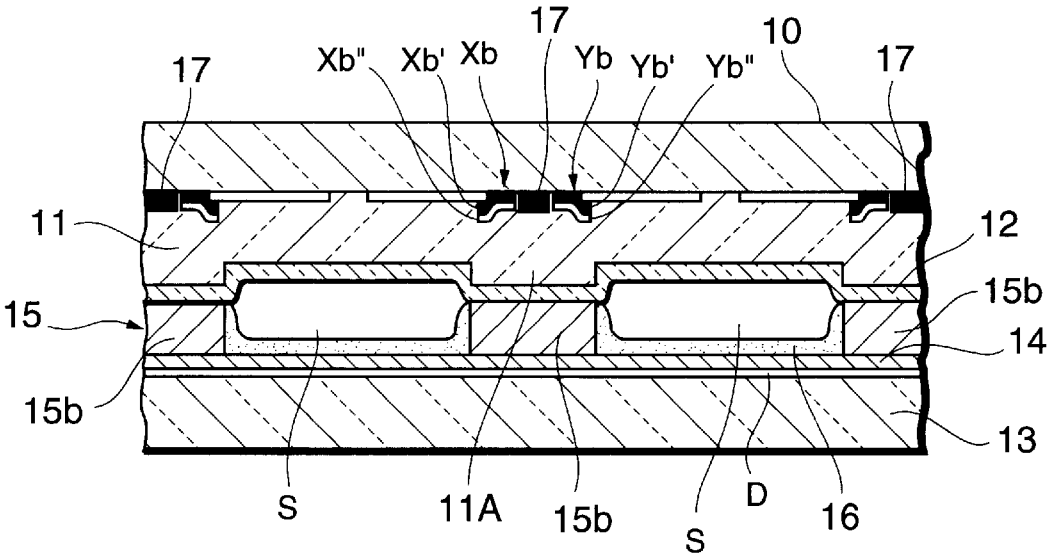
FIG. 10 is a cross-sectional view taken along the line V1—V1 of FIG. 9.
Figure 11:
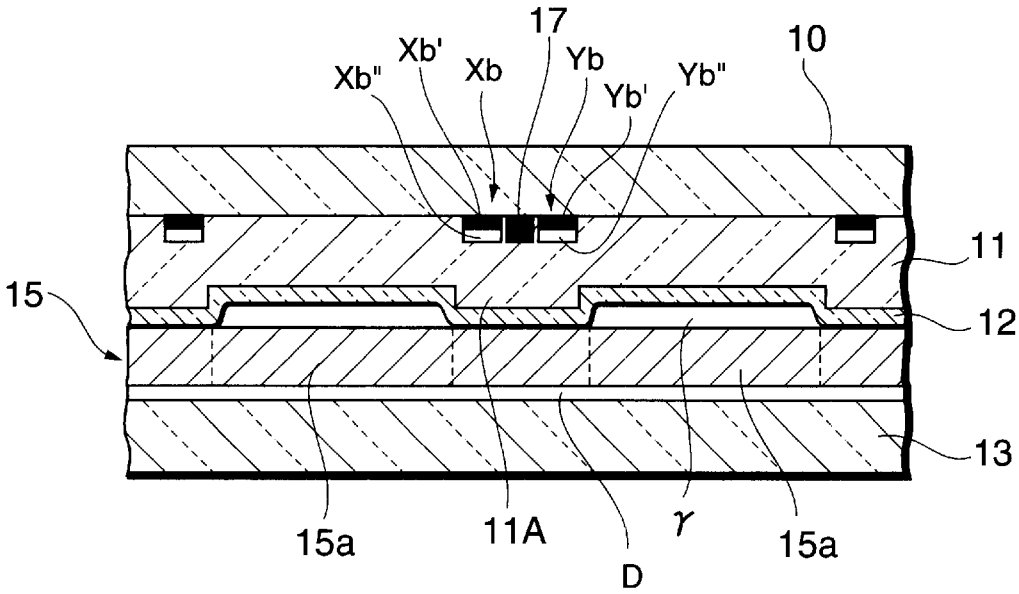
FIG. 11 is a cross-sectional view taken along the line V2—V2 of FIG. 9.

The structure of the discharge cell within the display region of this plasma display panel is the same as structure of the plasma display panel of FIGS. 6–8 with respect to the arrangement of column electrode pairs (X, Y) corresponding to the respective discharge cells C and in other respects. Accordingly, the corresponding components are designated by the same reference numerals.

However, row electrode pairs (X, Y) are not provided in the cells Ca, which are positioned adjacent to the discharge cells C at the outside of the display region of this plasma display panel.

Position alignment-use ribs 20 are disposed on the respective center portions of the cells Ca positioned at the outside of the display region. The position alignment-use ribs 20 are formed on the display-side surface of the rear glass substrate 13 in a manner which will be described later.

As seen from FIG. 1, these position alignment-use ribs 20 each have a rectangular shape, the longer side of which extends in the row direction (the direction of the display line L) of the plasma display panel, and are positioned such that distances A and B from the horizontal walls 15*b* at both-sides of the cell Ca are equal to each other.

The width m in the column direction of the position alignment-use rib 20 is set to be equal to, or slightly smaller than, the gap g between the opposing transparent electrodes Xa and Ya of the row electrode pair (X, Y). Also, the position of the position alignment-use rib 20 is set such that if the rib 20 is translated in the direction of the display line L, the resulting position would be between the transparent electrodes Xa and Ya.

The above-mentioned partition 15 and position alignment ribs 20 are formed in the following steps.

First, to form a glass layer, a low melting point glass paste made of a mixture of a low melting point glass frit and a binder is uniformly coated on dielectric layers 14, which have been formed on the rear glass substrate 13 to cover the column electrodes D (see FIG. 2).

Next, a dry film made of a photoresist material having anti-sand-blast characteristics is laminated on this glass layer. A resist mask is formed by patterning the dry film by photolithography so as to mask regions at which the partition 15 and the position alignment-use ribs 20 are to be formed.

Next, a sand blast treatment is performed on the glass layer through the resist mask to selectively remove the glass layer, thereby conducting a patterning to produce a predetermined pattern. Finally, after the dry photoresist film, which has been used as a mask, is removed, the patterned glass layer undergoes calcination to form the partition 15 and the position alignment-use ribs 20 at the same time.

When the front glass substrate 10 and the rear glass substrate 13 having the partition 15 and the position alignment-use ribs 20 formed thereon are to be cemented together in an aligned fashion, detection of the positional deviation between these substrates will be conducted as follows.

First, the front glass substrate 10 having the row electrode pairs (X, Y) and other structures formed thereon is superimposed on the rear glass substrate 13 having the partition 15, position alignment-use ribs 20, and other structures formed thereon, and they are temporarily fixed to each other by clips. Then, distances a and b from the position alignment-use rib 20 positioned in the cell Ca to the bus electrodes Xb and Yb, respectively, on the front glass substrate 10 (see FIG. 1) are measured to determine whether there is a difference between these distances a and b.

If the difference is found between the distances a and b, positional alignment between the front glass substrate 10 and the rear glass substrate 13 is performed to eliminate the difference, and thereafter the substrates are cemented together.

Figure 3:
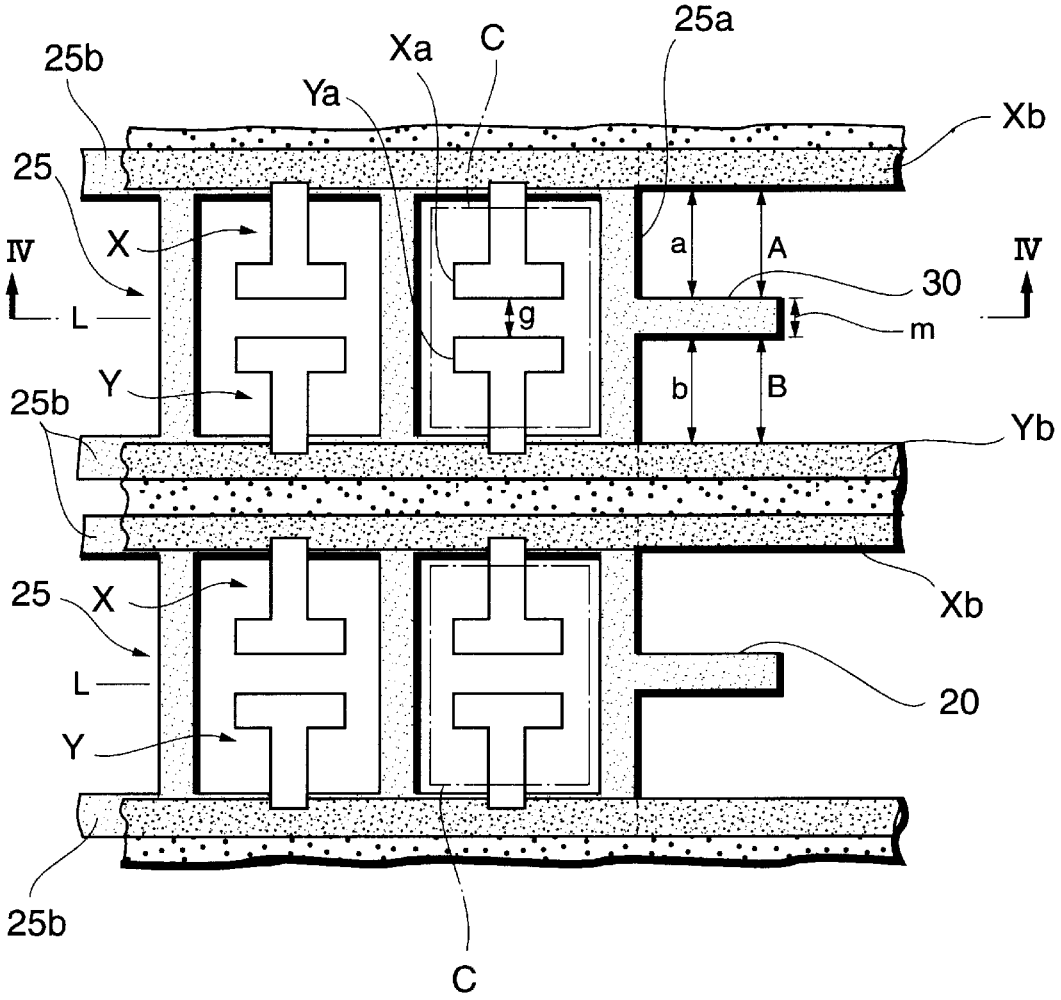
FIG. 3 is a plan view showing a second preferred embodiment according to the present invention.
Figure 4:
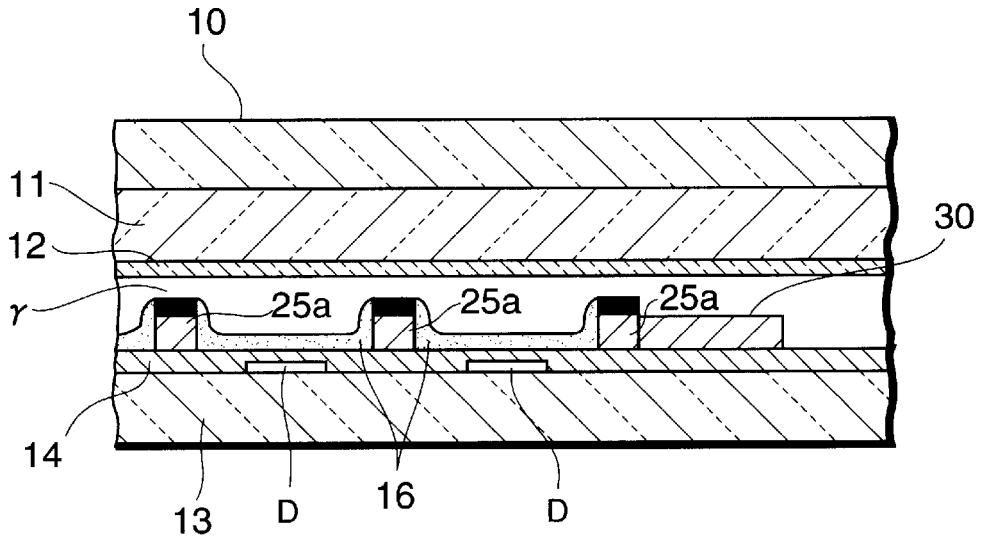
FIG. 4 is a cross-sectional view taken along the line IV—IV of FIG. 3.

FIG. 3 is a plane view showing a second preferred embodiment according to the present invention. FIG. 4 is a cross-sectional view taken along the line IV—IV of FIG. 3.

Figure 5:
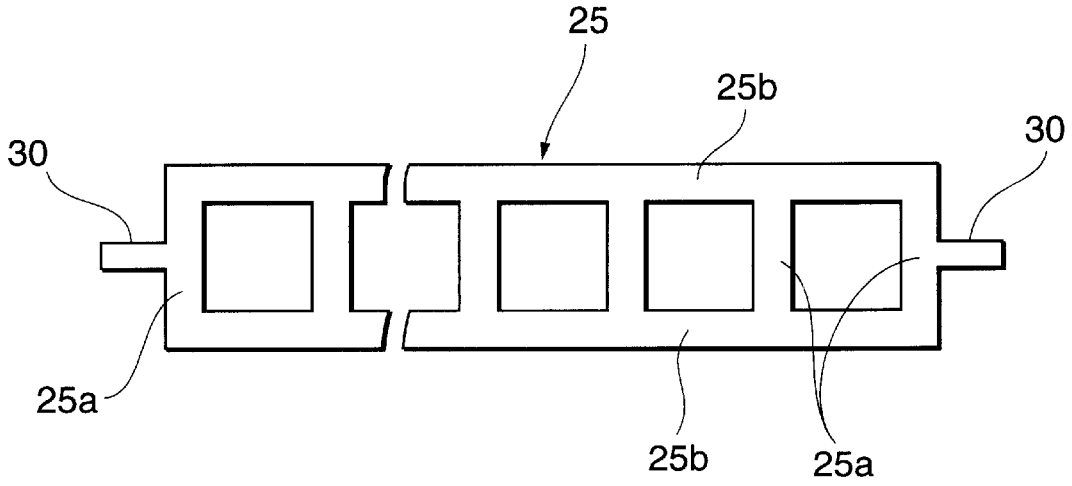
FIG. 5 is a plan view showing a partition of the second preferred embodiment.

Instead of the partition 15 formed of the vertical walls 15*a* and horizontal walls 15*b* in a lattice shape, in a plasma display panel of the second preferred embodiment, as shown in FIG. 5, partitions 25 defining discharge cells Care each formed of a pair of horizontal walls 25*b* extending in parallel with each other and of vertical walls 25*a* arranged at an equal interval in a direction orthogonal to and between the horizontal walls 25*b* in a so-called-ladder shape.

The thus constructed partitions 25 are arranged in the column direction in parallel with the row direction so that squire-shape discharge cells C are defined and arranged in the row and column directions in a manner similar to the partition 15 of the first preferred embodiment.

A position alignment-use rib 30 is formed in the vertical wall 25*a* positioned at each end of the partition 25 (FIGS. 3 and 4 show only the respective right end part) in an integral manner with the vertical wall 25*a*. The position alignment-use rib 30 extends outwardly from the center part of the outer side wall in a direction parallel to the horizontal walls 25*b*.

This position alignment-use rib 30 is positioned at the center of the vertical wall 25*a*, and the width m in the column direction thereof is equal to, or slightly smaller than, the gap g between the opposing transparent electrodes Xa and Ya of the row electrode pair (X, Y) in the same manner as in the case of the position alignment-use 20 of the above-mentioned first preferred embodiment. Also, the position of the position alignment-use rib 30 is set such that if the rib 30 is translated in the direction of the display line L, the resulting position would be between the transparent electrodes Xa and Ya.

The construction of other parts of this plasma display panel is the same as that of the plasma display panel of the first preferred embodiment, and accordingly, such parts are designated by the same reference numerals.

In assembling this plasma display panel, in a manner similar to the case of the first preferred embodiment, the front glass substrate 10 having the row electrode pairs (X, Y) and other structures formed thereon is superimposed on the rear glass substrate 13 having the partitions 25, position alignment-use ribs 30, and other structures formed thereon, and they are temporarily fixed to each other by clips. Then, distances a and b from the position alignment-use rib 30, which extends from the vertical wall 25*a*, to the bus electrodes Xb and Yb, respectively, on the front glass substrate 10 (see FIG. 3) are measured at the both sides of the respective partition 25 to determine whether there is a difference between these distances a and b.

If the difference is found between the distances a and b, positional alignment between the front glass substrate 10 and the rear glass substrate 13 is performed to eliminate the difference, and thereafter the substrates are cemented together.

As explained above, the position alignment-use ribs 30 are positioned at the outside of the display region of the resulting plasma display panel.

Here, although in the description above, the first preferred embodiment has been explained in the case of the plasma display panel equipped with the lattice-shape partition 15, the position alignment-use ribs 20 may instead be installed in a plasma display panel equipped with the ladder-shape partitions 25 as in the case of the second preferred embodiment.

Also, although the second preferred embodiment has been explained in the case of the plasma display panel equipped with the ladder-shape partitions 25, the position alignment-use ribs 30 may be installed in a plasma display panel equipped with a lattice-shape partition 15 as in the case of first preferred embodiment.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. In a plasma display panel comprising a front substrate and a rear substrate opposite to the front substrate with a discharge space therebetween, said front substrate having thereon a plurality of row electrode pairs extending in a row direction and arranged in parallel in a column direction, each of the plurality of row electrode pairs defining a corresponding display line, said rear substrate having thereon a plurality of column electrodes extending in the column direction and arranged in parallel in the row direction, the column electrodes defining unit luminous regions in the discharge space at their respective intersecting positions with the row electrode pairs, a position alignment structure for the plasma display panel comprising:

a partition on said rear substrate, having vertical wall parts extending in the column direction and horizontal wall parts extending in the row direction to partition the discharge space between said front substrate and said rear substrate in the column and row directions in accordance with the unit luminous regions; and a position alignment-use rib formed on said rear substrate and positioned at an outside of a display region of the plasma display panel for detecting a position of said front substrate relative to said rear substrate.

2. A position alignment structure for a plasma display panel according to claim 1, wherein said position alignment-use rib on said rear substrate is formed in a space positioned at the outside of the display region of the plasma display panel among spaces defined by said partition.

3. A position alignment structure for a plasma display panel according to claim 2, wherein said position alignment-use rib is formed at a position separated from the opposing horizontal wall parts of said partition defining the space having said position alignment-use rib therein by respective distances being substantially the same at both sides.

4. A position alignment structure for a plasma display panel according to claim 1, wherein a position of said position alignment-use rib is set such that if said position alignment-use rib is translated in the row direction, the resulting position being between two electrodes constituting said row electrode pair.

5. A position alignment structure for a plasma display panel according to claim 1, wherein said partition and said position alignment-use rib are formed by patterning a glass layer in accordance with a predetermined pattern, the glass layer being formed on said rear substrate at a side facing said front substrate and being formed of a glass having a low melting point.

6. A position alignment structure for a plasma display panel according to claim 1, wherein said position alignment-use rib on said rear substrate extends outwardly from the vertical wall part positioned at an end of the partition in a direction parallel to the horizontal wall parts, said position alignment-use rib being formed integrally with the partition.

7. A position alignment structure for a plasma display panel according to claim 6, wherein said position-alignment rib is formed at a substantially center position of said vertical wall part of the partition.

* * * * *